United States Patent [19]

James

[11] 4,430,844

[45] Feb. 14, 1984

[54] METHOD OF AND APPARATUS FOR WRAPPING ARTICLES

[75] Inventor: Robert C. James, Sheboygan, Wis.

[73] Assignee: Hayssen Manufacturing Company, Sheboygan, Wis.

[21] Appl. No.: 257,565

[22] Filed: Apr. 27, 1981

[51] Int. Cl.[3] ..... B65B 9/06

[52] U.S. Cl. ..... 53/450; 53/141; 53/547; 53/550

[58] Field of Search ..... 53/450, 462, 463, 459, 53/547, 389, 207, 208, 141, 591, 550, 551

[56] References Cited

U.S. PATENT DOCUMENTS

| | | | |
|---|---|---|---|
| 2,276,282 | 3/1942 | Bindszus | 53/450 X |
| 2,877,609 | 3/1959 | Bodolay et al. | 53/455 |
| 3,168,016 | 2/1965 | Kehr | 53/450 |
| 3,303,630 | 2/1967 | Harm | 53/450 X |
| 3,815,318 | 6/1974 | Lerner | 53/459 |
| 3,817,017 | 6/1974 | Titchenal | 53/459 X |
| 3,930,350 | 1/1976 | Reid | 53/455 X |
| 4,035,984 | 7/1977 | Gerlach et al. | 53/450 |
| 4,171,605 | 10/1979 | Putnam, Jr. et al. | 53/552 |
| 4,218,863 | 8/1980 | Howard et al. | 53/547 |

FOREIGN PATENT DOCUMENTS

| | | |
|---|---|---|
| 1309861 | 3/1973 | United Kingdom . |
| 1361162 | 7/1974 | United Kingdom . |

*Primary Examiner*—Horace M. Culver

*Attorney, Agent, or Firm*—Senniger, Powers, Leavitt and Roedel

[57] ABSTRACT

A method of and apparatus for wrapping units to be wrapped, such as two rolls of paper, in which transverse lines of weakness are formed in a web of flexible sheet wrapping material at measured intervals along the length of the web corresponding to wrapper length as the web is continuously fed forward, the web is formed into a tube around the units with the lines of weakness extending girthwise of the tube and spaced lengthwise of the tube at the wrapper length intervals, the units are fed into the tube one after another spaced lengthwise in the tube at wrapper length intervals and located between the lines of weakness, the tube with the units therein is continuously fed forward at a predetermined speed, and the leading wrapper of the tube with a unit therein is pulled forward at higher speed to sever it from the tube at the line of weakness between it and the preceding wrapper.

23 Claims, 7 Drawing Figures

METHOD OF AND APPARATUS FOR WRAPPING ARTICLES

BACKGROUND OF THE INVENTION

This invention relates to methods of and apparatus for wrapping articles, and more particularly to a method of and apparatus for wrapping rolls of paper, such as rolls of toilet tissue or paper towel rolls, in flexible sheet wrapping material such as heat-sealable plastic film.

The invention is especially concerned with a type of continuous wrapping in which a web of wrapping material is formed into a tube, the tube is continuously fed forward, units to be wrapped are fed into the tube spaced at intervals longitudinally of the tube, and the tube as it is fed forward is separated between the units to form individual packages, each comprising a unit enwrapped in the wrapping material. Reference may be made to British Pat. No. 1,361,162, the complete specification of which was published July 24, 1974 U.S. Pat. No. 4,218,863 issued Aug. 26, 1980 entitled Continuous Motion Wrapping Machine and British Pat. No. 1,309,861, the complete specification of which was published Mar. 14, 1973, showing wrapping of this general type.

SUMMARY OF THE INVENTION

Among the several objects of this invention may be noted the provision of an improved method and apparatus for wrapping articles such as rolls of paper, e.g. toilet tissue or paper toweling, at relatively high speed (i.e. rate of production) and enabling use of various wrapping materials; the provision of such a method and apparatus for continuously wrapping articles wherein speed is not limited by reason of having to cut the tube transversely as it is continuously fed forward; and the provision of such a method and apparatus which effects separation without heat-shrinking and thus enables wrapping with materials which are not heat-shrinkable and without having to heat the tube and the enwrapped articles.

Generally, the invention involves passing a web of sheet material for wrapping the units from a supply roll through a positively driven web feeding means for positively and continuously feeding the web forward at a predetermined speed. Lines of weakness are provided in the web extending across the web at wrapper formed in the web extending across the web at wrapper length intervals. The web with the lines of weakness therein passes to and through a tube forming means and thence between a plurality of endless drive belts. Units to be wrapped are positively delivered forward one after another at said speed to the tube forming means for being wrapped in the web travelling forward through said means, with the units spaced at intervals corresponding to the wrapper length interval and with spaces between the units. The web in travelling through said means is wrapped around the units with its margins brought together to form it into a tube around the units, with the units spaced lengthwise of the tube, and with the lines of weakness extending girthwise of the tube at said wrapper length intervals in the spaces between the units. The drive belts are operated positively and continuously to take up the web from said web feeding means, to pull it through the tube forming means and to feed the tube with the units enwrapped therein forward between the belts at said speed. The positive feed of the tube with the units enwrapped therein starts as the tube with a unit therein exits from the tube forming means and before the positive delivery of that unit to the tube forming means is completed, the positive delivery of that unit to the tube forming means being completed before the wrapping of the web around that unit to form the tube is completed. The segments of the tube between the lines of weakness form a series of wrappers for the units adapted to be separated at the lines of weakness. The leading wrapper of the series of wrappers with the units therein is pulled forward at a higher speed to sever it, with the unit therein, from the tube at the line of weakness between said leading wrapper and the preceding wrapper.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
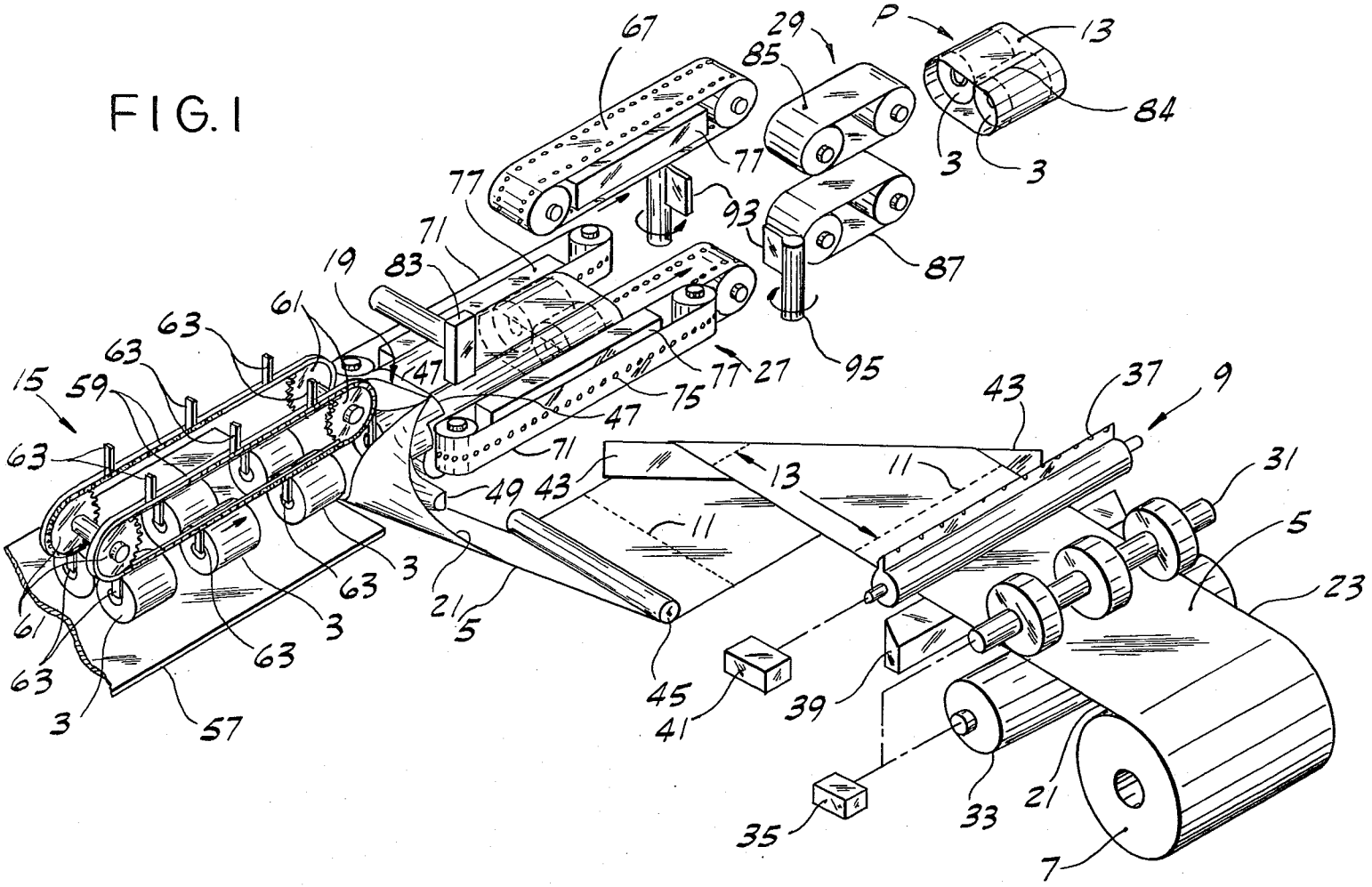
FIG. 1 is a semi-diagrammatic perspective illustrating the method and apparatus of this invention, showing the wrapping of units each consisting of two rolls of paper (e.g. toilet tissue) side-by-side, an upper belt of the apparatus being shown in a position above its actual position to enable illustration of parts therebelow, and certain of the wrapped units being omitted for better illustration of details.

Referring to the drawings, the invention is shown as applied to the wrapping of individual units 1 each consisting of two rolls of paper 3, e.g. toilet tissue, disposed in side-by-side relation with the roll axes parallel. It will be understood, of course, that the invention is applicable to the wrapping of items other than rolls of paper, with each unit wrapped consisting of a single article, or of various numbers of articles. The invention has been developed especially for wrapping rolls of paper, more particularly toilet tissue and paper toweling, and it is contemplated that it may be used to wrap single rolls, two-roll units, three roll units, four-roll units, six roll units, etc. The units 1 are wrapped in a web 5 of suitable flexible sheet wrapping material, such as a heat-sealable plastic film (e.g. polyethylene film) which is fed forward from a supply roll 7 and, as it is fed forward from the roll 7, formed by means indicated generally at 9 with lines of weakness 11 extending transversely thereacross spaced lengthwise of the web at wrapper length intervals 13. The wrapper length interval 13 is greater than the lengthwise dimension of a unit, i.e., the axial dimension of a roll.

The two-roll units 1 to be wrapped are positively fed forward in a horizontal path by means indicated generally at 15 one after another spaced at intervals corresponding to the wrapper length interval 13 and with spaces such as indicated at 17 between the units. The web 5, after having passed through the means 9 for forming the lines of weakness 11, is formed by means indicated at 19 into a tube T around the units 1 with the line of weakness 11 extending girthwise of the tube in the spaces 17 between the units, the side margins 21 and 23 of the web being brought together in forming the tube. The segments of the tube T, also designed by the reference numeral 13, between successive lines of perforation 11 form a series of wrappers for the units 1 adapted to be separated at the lines of weakness 11. The tube with the units 1 therein, spaced at wrapper length intervals, is fed forward in the stated horizontal path by means indicated generally at 27 at a predetermined speed and, finally, the leading wrapper **13*a* of the tube with the respective unit 1 therein is pulled forward by means indicated generally at 29 at a higher speed to sever it, with the unit 1 therein, from the tube at the line of weakness between it and the preceding wrapper 13*b***.

Figure 4:
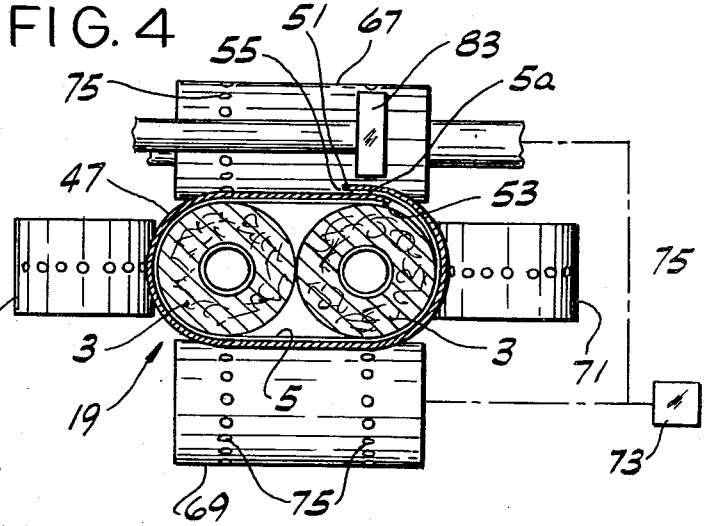
FIG. 4 is a transverse vertical section on line 4—4 of FIG. 2.

As illustrated in FIG. 1, the web 5 is positively continuously pulled from the supply roll 7 and fed forward in a horizontal path at right angles to and below the path of the tube T by a pair of web feed rolls 31 and 33 driven by means indicated generally at 35 at the same speed as the tube feed means 27. The web travels horizontally forward from the rolls 31,33 through means 9, which preferably comprises rotary web-perforating knife 37 acting in conjunction with a stationary back-up shear blade 39 for forming the lines of weakness 11 as lines of perforations across the web from one side margin to the other. The perforating knife is driven by means such as indicated generally at 41 with its speed so related to that of the web feed rolls 31,33 as to form the lines of perforations 11 at the desired wrapper length interval. Rolls 31,33 are in effect measuring rolls for measuring out wrapper length intervals of the web for the perforating operation. As illustrated in FIG. 1, the perforating knife is formed to cut perforations in the web, the exact length of the perforation and the connecting bridge of material being dependent on the type and thickness of the web of packaging material used. The web, after having been thus perforated, is redirected at 90° to its initial direction by a turning bar 43 angled at 45° to said direction located below the tube feed means 27, then travels rearward relative to the tube feed means below the latter, and is trained under and up around a guide roll 45 to the tube former 19. The latter is similar to the tube formers used in vertical form/fill-/seal machines, with modifications for purposes of this invention, comprising a tubular guide 47 which in transverse section, as shown in FIG. 4, corresponds generally to the transverse cross section of the two side-by-side rolls 3 of a unit 1 (instead of being circular). The tubular guide 47 extends horizontally in the path of the units 1 and the tube T. At its rearward end, the tubular guide 47 has a shoulder 49 for guiding the web 5 from roll 45 up, around and forward into the guide 47 for forming it into the tube T. Guide 47 has overlapping margins 51 and 53 at its forward (downstream) end at the top, these margins being spaced to provide a longitudinal passage 55 for travel of margin 21 of the web 5. Rather than being centered in the central vertical longitudinal place of the guide 47, the margins 51 and 53 of the guide and hence the passage 55 are offset toward one side of the guide (toward the right side as viewed in forward direction and as herein illustrated in FIG. 4).

The arrangement is such that as the web 5 travels up and around the shoulder 49, its formation into the tube T is initiated and, as it proceeds through the tubular guide 47, it becomes wrapped around the units 1 delivered to the guide with margin 21 of the web in the slot 55 above the margin 53 of the guide and margin 23 of the web below margin 53 of the guide and on top of the roll 3 toward the right-hand side of the guide. Thus, the margins 21 and 23 of the web are brought together to be in overlapping relation (21 on top of 23) in line with and on top of the right-hand rolls 3 of the units 1 as the tube T with the units 1 therein exits from the guide 47.

The means 15 for feeding the units 1 forward and delivering them to the tube former 19 is shown as a flight conveyor comprising a table 57 at the level of the bottom of the guide 47 and a pair of endless chains 59 trained around sprockets 61 to have a lower forward travelling reach above the table and an upper return reach, the chains carrying pushers 63 for pushing the units forward on the table. The pushers are paired in side-by-side relation, with each pair spaced apart a distance corresponding to the wrapper length interval 13, for pushing the two rolls 3 of a unit 1 in side-by-side relation along the table to the guide 47. Suitable drive means such as indicated at 65 is provided for the flight conveyor 15 for continuously driving it for forward travel of its lower reach at a speed corresponding to the speed of travel of the web 5 and with the pusher pairs 63 moving in phase with perforator knife 37 for delivery of the units 1 to the web as the web comes up around the shoulder or, horn 49 and enters the guide 47 with the units generally centered between the successive lines of perforations 11 in the web (so that there is one unit per wrapper 13).

Figure 2:
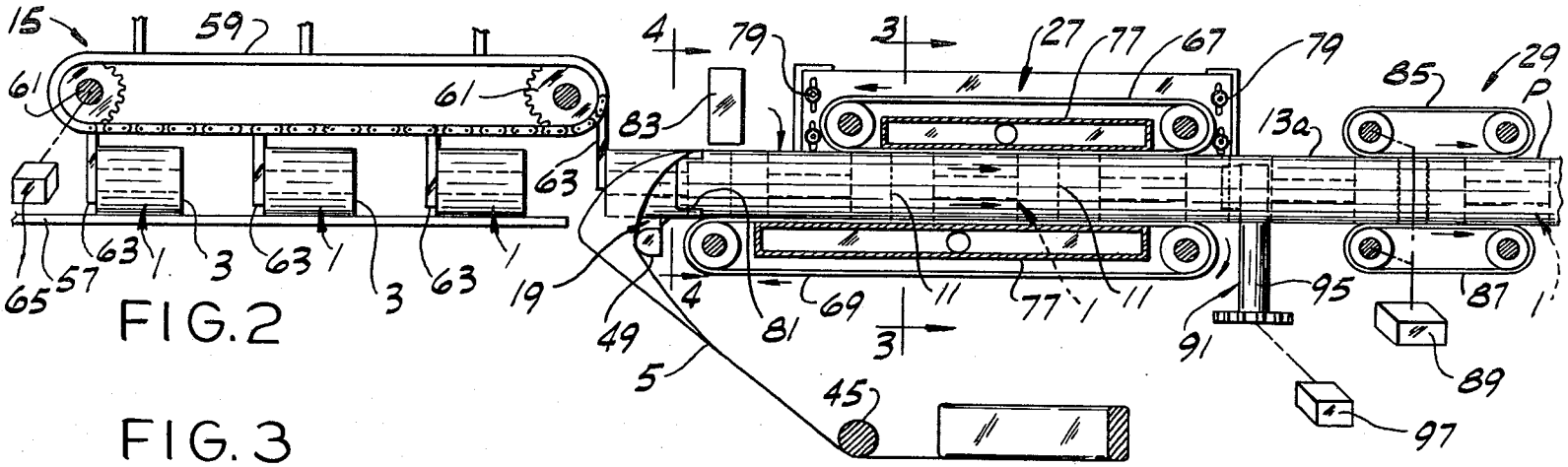
FIG. 2 is a vertical longitudinal section of the apparatus.
Figure 3:
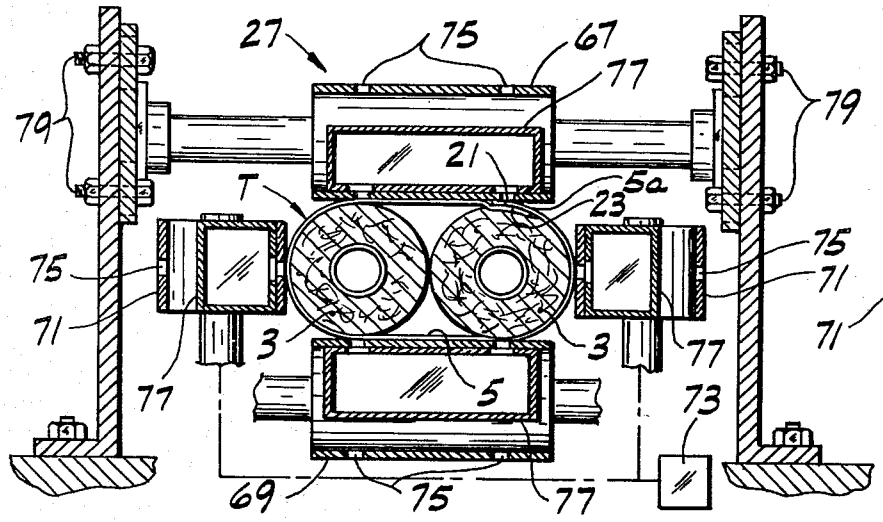
FIG. 3 is a transverse vertical section on line 3—3 of FIG. 2.

The tube feed means 27 and the web feed rolls 31,33 act as means for feeding the web 5 forward from the supply roll 7 to the tube former 19 where the web is formed into the tube at a predetermined speed, which in the case of the two-roll units 1 of toilet tissue may be 270 feet per minute (corresponding to a rate of 300 units per minute). As illustrated, the tube feed means 27 comprises endless belt means engageable with the tube T with the units 1 therein to feed the tube with the units 1 therein forward at said predetermined speed. More particularly, an upper drive belt 67, a lower drive belt 69 and side drive belts 71 are provided, the upper belt having a lower reach, the lower belt having an upper reach and the side belt having inside reaches engageable with the tube and the units therein. Suitable drive means such as indicated at 73 is provided for continuously driving these belts for forward travel of the stated tube-engaging reaches to drive the tube forward. The units inside the tube act as a back-up for said forward-traveling reaches. The belts are preferably vacuum belts, having vacuum holes such as indicated at 75, vacuum boxes such as indicated at 77 being provided on the inside of their forward traveling reaches, for effecting vacuum gripping of the tube T by the forward traveling reaches via the holes. The upper belt 67 may be adjustable toward and away from the lower belt 69 as suggested at 79 in FIGS. 2 and 3 and the side belts 71 may be adjustable toward and away from one another for operation on units of different sizes and shapes; the tube former 19 is removable and replaceable with tube former of different sizes and shapes for this purpose.

The lower belt 69 and the side belts 71 of the tube feed means 27 are longer than the upper belt 67 of the tube feed means, and extend rearward (upstream) from below the upper belts. The side belts 71 extend rearward from the lower belt 69. The entrance (upstream) ends of the inside tube-engaging reaches of the side belts 71 are received in cutouts or notches 81 at the sides of the guide 47 at its forward (downstream) end so that the inside reaches of the side belts engage the tube before it exits from the guide. The entrance end of the side belts is spaced downstream from the exit end of the unit conveyor a distance so related to the length (the axial dimension) of a roll 3 that the side belts engage a unit at the forward end of the unit just before the pusher 63 which engage the rear end of the unit travel up and out of engagement with the rear end of the unit, thereby effecting a positive transfer of the unit feed from the pushers to the belts. The entrance end of the lower belt 69 is at the exit end of the guide 47 (downstream from the exit end of the side belts). The flight conveyor 15 is of a known type in which the pushers 63 extend vertically downward as they move up at the downstream end of the conveyor, and then swing to extend vertically upward as they travel with the upper return reach of the conveyor. The entrance end of the upper belt 67 is spaced downstream from the exit end of the guide 47 and in this space is located means 83 for effecting heat-sealing together of the overlapping margins 21,23 of the web to form a longitudinal tube seam 84. This means, which is located in line with the overlapping margins 51,53 of the guide 47, may comprise, for example, means for blowing hot air on the tube. It may be mounted to be swung between an operative position (FIG. 1) just above the tube T and a retracted position clear of the tube for the starting and stopping of operation of the apparatus.

The aforesaid pulling means 29 (which may also be referred to as the tube speed-up means) comprises endless belt means in line with the tube feed means engageable with the leading wrapper 13*a* of the series with a unit 1 therein, the entrance end of this means 29 being spaced some distance downstream from the exit end of the tube feed means 27. More particularly, means 29 comprises an upper belt 85 and a lower belt 87, the upper belt having a lower reach and the lower belt having an upper reach engageable with the tube T with a unit 1 therein. Suitable drive means such as indicated at 89 is provided for continuously driving these belts for forward travel of their stated tube-engaging reaches at a somewhat higher speed than the speed of the belts of the tube feed means 27.

To facilitate the action of belts 85,87 in pulling the leading wrapper 13*a* of the tube T with a unit 1 therein to sever it from the tube at the line of weakness between it and the preceding wrapper 13*b*, the tube may be partially severed at this line of weakness by means indicated generally at 91 preliminary to the complete severing by pulling of the leading wraper 13*a* with the unit therein. This means comprises a pair of what may be called prebreakers each designated 93 operable to strike the tube from the outside at opposite sides of the tube at the spaces 17 between units to pre-sever the tube under tension at the line of weakness 11 between the leading wrapper and the preceding wrapper thereby partially to sever it at this line of weakness. The prebreakers are located at a prebreaker station between the exit end of the tube feed means 27 and the entry end of the pulling means 29. Each prebreaker is shown as comprising an arm extending radially from the upper end of a vertical shaft 95. The shafts are located closely adjacent the sides of the tube and the arms are generally at the level of the central horizontal plane of the tube and of such length as to be adapted, on each revolution, to swing into engagement with the tube and then out of engagement with the tube. Suitable drive means such as indicated at 97 is provided for driving the shafts to rotate the arms 93 in opposite directions with each arm swinging forward with the tube as the arm comes into engagement with the tube and swinging rearward as the arm swings out of engagement with the tube and returns for its next cycle. The arms are driven at such speed and in such phase relative to the tube as to swing in to strike the tube as each line of weakness approaches the prebreaker station (see FIGS. 5 and 6), and then to swing out to clear the tube before the next unit in the tube reaches the prebreaker station to allow for the passage of the next unit 1 in the tube. In other words, the prebreakers move in and out in timed relation to the travel of the tube to act on the tube at the spaces between units 1 in the tube and to be out of the way to allow units 1 to pass on by.

Figure 5:
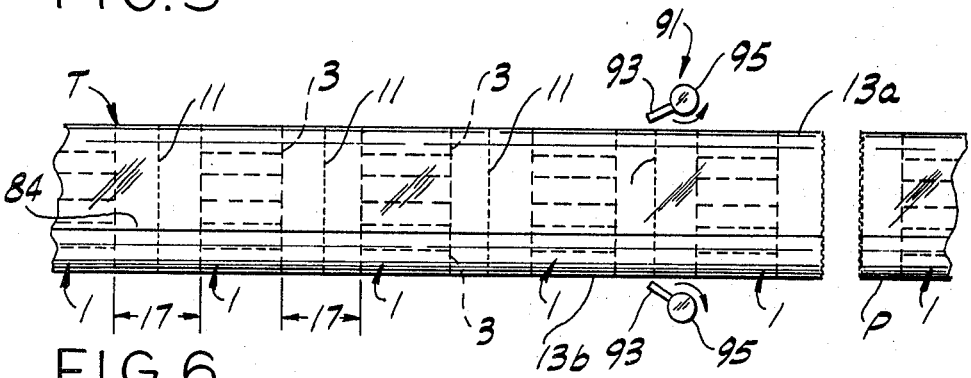
FIG. 5 is a fragmentary plan showing certain so-called "prebreakers" of the apparatus.
Figure 6:
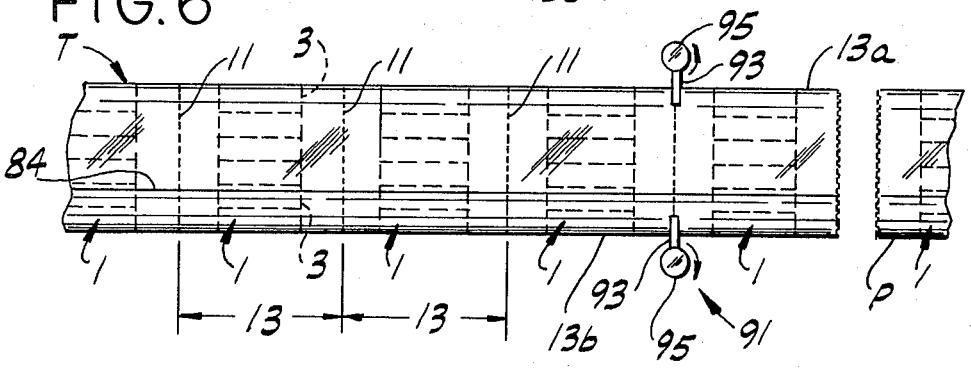
FIG. 6 is a view similar to FIG. 5 showing the prebreakers in a moved position.
Figure 7:
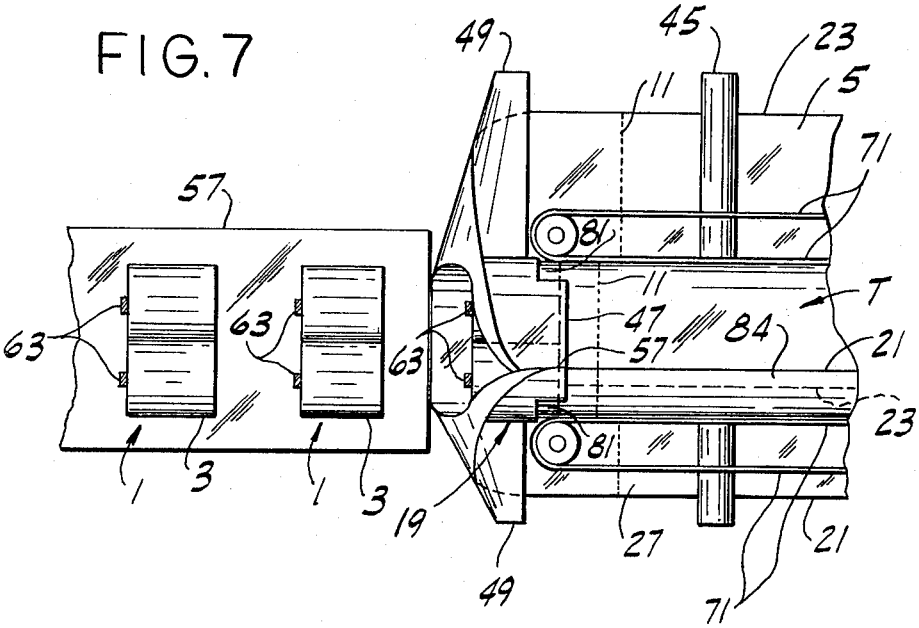
FIG. 7 is a fragmentary plan showing tube-forming means of the apparatus.

In operation, the web 5 is continuously drawn from the supply roll 7 and fed forward at the requisite speed corresponding to the tube feed speed by the rolls 31,33. As it travels forward, it is perforated to form the lines of perforations 11 at the wrapper length intervals 13 by the rotary knife 37, which is driven in timed relation to the web feed in accordance with the requisite wrapper length interval. Having been perforated, the web travels around bar 43, under roll 45, up to the shoulder 49 of the tube former 19, around this shoulder and into and through the guide 47 of the former. Two-roll units 1 are continuously fed forward, one after another, by the flight conveyor 15 into the guide 47, the units coming into position on the web 5 as it travels forward through the guide. In the latter, the web is formed into the tube T around the units, the tube with the units therein being drawn out of the guide and fed forward at the stated tube feed speed by the tube feeding means 27 comprising the belts 67, 69 and 71, the tube with the units enwrapped therein passing between the belts. As the tube exits from the guide 47, means 83 forms the longitudinal tube seam 84 in line with the right-hand rolls 3 (right-hand as viewed looking downstream) of the units 1. As the leading (downstream) end of the tube T enters the pulling or speed-up means 29 comprising belts 87 and 89, prebreakers 93 engage the tube at opposite sides thereof partially to sever it at the line of perforations 11 between the leading wrapper 13*a* of the series of wrappers 13 which constitute the tube and the preceding wrapper 13*b*. Pulling means 29 then immediately pulls the leading wrapper 13*a* with the unit 1 therein forward at a higher speed than the tube speed (the latter speed being determined by means 27) to sever the leading wrapper with the unit therein away from the tube at the now partially severed line of weakness. Thus, packages such as indicated at P in FIGS. 1, 5 and 6 are separated from the tube, each comprising a wrapper 13 with a unit 1 therein with the ends of the wrapper extending beyond the ends of the unit. As will be readily understood, these projecting wrapper ends are subsequently folded in on the ends of the unit and sealed to complete the package.

It will be observed that the wrappers 13 are, in effect, measured as a result of the timed relation between the speed of feed of the web and the speed of rotation of the perforating knife 37, formed into the tube T around the units 1 by being drawn through the tube former 19, and pulled by belts 85,87 to separate them. The separation occurs as a result of belts 85,87 gripping the leading wrapper 13*a* at the unit 1 therein and feeding it forward somewhat faster than the preceding wrappers with units 1 therein are being fed forward by the belts 67,69,71, the leading wrapper being gripped by belts 85 and 87 before the grip of belts 67,69 and 71 on the tube (including the preceding wrapper 13*b*) is released.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of wrapping units to be wrapped comprising:

passing a web of sheet material for wrapping the units from a supply roll through a positively driven web feeding means for positively and continuously feeding the web forward at a predetermined speed;

forming lines of weakness in the web extending across the web at wrapper length intervals as it is positively fed forward from the supply roll by said web feeding means;

passing the web with the lines of weakness therein to and through a tube forming means and thence between a plurality of endless drive belts;

positively delivering units to be wrapped forward one after another at said speed to the tube forming means for being wrapped in the web travelling forward through said means, with the units spaced at intervals corresponding to the wrapper length interval and with spaces between the units;

the web in travelling through said means being wrapped around the units with its margins brought together to form it into a tube around the units, with the units spaced lengthwise of the tube, and with the lines of weakness extending girthwise of the tube at said wrapper length intervals in the spaces between the units;

operating said drive belts positively and continuously to take up the web from said web feeding means, to pull it through the tube forming means and to feed the tube with the units enwrapped therein forward between the belts at said speed;

said positive feed of the tube with the units enwrapped therein starting as the tube with a unit therein exits from the tube forming means and before the positive delivery of that unit to the tube forming means is completed, the positive delivery of that unit to the tube forming means being completed before the wrapping of the web around that unit to form the tube is completed;

the segments of the tube between the lines of weakness forming a series of wrappers for the units adapted to be separated at the lines of weakness; and pulling the leading wrapper of the series of wrappers with the units therein forward at a higher speed to sever it, with the unit therein, from the tube at the line of weakness between said leading wrapper and the preceding wrapper.

2. The method of claim 1 further comprising the step of partially severing the tube at the line of weakness between the leading wrapper and the next wrapper preliminary to complete severing by pulling of the said leading wrapper.

3. The method of claim 2 wherein the tube is partially severed at the line of weakness between the leading wrapper and the next wrapper by striking it from the outside.

4. The method of claim 3 wherein the tube is struck from the outside at two opposite sides.

5. The method of claim 1 wherein each unit comprises a plurality of rolls of paper positioned side-by-side with their axes extending generally horizontally in the direction of feed and wherein the margins of the web are brought together on one of said side-by-side rolls and sealed to form a longitudinal seam for the tube at one side.

6. The method of claim 5 further comprising the step of partially severing the tube at the line of weakness between the leading wrapper and the next wrapper preliminary to complete severing by pulling of the said leading wrapper.

7. The method of claim 6 wherein the tube is partially severed at the line of weakness between the leading wrapper and the next wrapper by striking it from the outside.

8. The method of claim 7 wherein the tube is struck from the outside at two opposite sides.

9. The method of claim 1 wherein the tube is gripped to the belts by vacuum.

10. The method of wrapping units to be wrapped comprising:

passing a web of sheet material for wrapping the units from a supply roll through a positively driven web feeding means for positively and continuously feeding the web forward at a predetermined speed;

the web being provided with lines of weakness extending thereacross at wrapper length intervals;

passing the web with the lines of weakness therein to and through a tube forming means and thence between a plurality of endless drive belts;

positively delivering units to be wrapped forward one after another at said speed to the tube forming means for being wrapped in the web travelling forward through said means, with the units spaced at intervals corresponding to the wrapper length interval and with spaces between the units;

the web in travelling through said means being wrapped around the units with its margins brought together to form it into a tube around the units, with the units spaced lengthwise of the tube, and with the lines of weakness extending girthwise of the tube at said wrapper length intervals in the spaces between the units;

operating said drive belts positively and continuously to take up the web from said web feeding means, to pull it through the tube forming means and to feed the tube with the units enwrapped therein forward between the belts at said speed;

said positive feed of the tube with the units enwrapped therein starting as the tube with a unit therein exits from the tube forming means and before the positive delivery of that unit to the tube forming means is completed, the positive delivery of that unit to the tube forming means being completed before the wrapping of the web around that unit to form the tube is completed;

the segments of the tube between the lines of weakness forming a series of wrappers for the units adapted to be separated at the lines of weakness; and pulling the leading wrapper of the series of wrappers with the units therein forward at a higher speed to sever it, with the unit therein, from the tube at the line of weakness between said leading wrapper and the preceding wrapper.

11. Apparatus for wrapping units to be wrapped comprising:

means for positively and continuously feeding forward a web of sheet material for wrapping the units from a supply roll at a predetermined speed;

means for forming lines of weakness in the web extending across the web at wrapper length intervals as it is positively fed forward from the supply roll by said web feeding means;

means for forming the web with the lines of weakness therein into a tube around the units;

a plurality of endless drive belts extending downstream from the tube forming means arranged for passage therebetween of the tube with the units therein;

means for driving said drive belts positively and continuously to take up the web from said web feeding means to pull it through the tube forming means and to feed the tube with the units enwrapped therein forward between the belts at said speed;

means for positively delivering units to be wrapped forward one after another at said speed to the tube forming means for being wrapped in the web travelling forward through the tub forming means, with the units spaced at intervals corresponding to the wrapper length intervals and with spaces between the units;

said tube forming means being so constructed and arranged that the web, in travelling therethrough, is wrapped around the units and its margins brought together to form the web into the tube around the units, with the units spaced lengthwise of the tube, and with the lines of weakness extending girthwise of the tube at said wrapper length intervals in the spaces between the units;

the means for positively delivering the units completing the delivery of each unit to the tube forming means before the wrapping of the web around that unit is completed;

the entrance end of the drive belts being located for engagement of the belts with the tube as the tube, with a unit therein, exits from the tube forming means and before the positive delivery of that unit to the tube is completed;

the segments of the tube between the lines of weakness forming a series of wrappers for the units adapted to be separated at the lines of weakness, and means downstream from said belts for pulling the leading wrapper of the series of wrappers with the units therein forward at a higher speed to sever it, with the unit therein, from the tube at the line of weakness between said leading wrapper and the preceding wrapper.

12. Apparatus as set forth in claim 11 further having means for partially severing the tube at the line of weakness between the leading wrapper and the next wrapper preliminary to complete severing by pulling of the said leading wrapper.

13. Apparatus as set forth in claim 12 wherein the means for partially severing the tube comprises means for striking it from the outside.

14. Apparatus as set forth in claim 13 wherein the means for striking the web strikes it at two opposite sides.

15. Apparatus as set forth in claim 11 for wrapping units each comprising a plurality of rolls of paper positioned side-by-side with their axes extending generally horizontally in the direction of feed, wherein said tube forming means is constructed and arranged to bring the margins of the web together over on one of said side-by-side rolls and wherein means is provided for sealing the margins to form a longitudinal tube seam in line with one of the rolls of each unit.

16. Apparatus as set forth in claim 15 further having means for partially severing the tube at the line of weakness between the leading wrapper and the next wrapper preliminary to complete severing by pulling of the said leading wrapper.

17. Apparatus as set forth in claim 16 wherein the means for partially severing the tube comprises means for striking it from the outside.

18. Apparatus as set forth in claim 17 wherein the means for striking the web strikes it at two opposite sides.

19. Apparatus as set forth in claim 11 wherein the drive belts are vacuum belts.

20. Apparatus as set forth in claim 11 wherein said tube forming means comprises a tubular member which in transverse section corresponds generally to the transverse cross section of a unit and which has overlapping margins for passage therebetween of one margin of the web.

21. Apparatus as set forth in claim 20 wherein said tubular member has notches at its downstream end, the entrance end of at least some of said belts being received in the notches.

22. Apparatus as set forth in claim 11 for wrapping units each comprising rolls of paper positioned side-by-side with their axes extending in the direction of feed, wherein said tube forming means comprises a tubular member which in transverse section corresponds generally to the transverse cross section of the unit and which has overlapping margins located in line with one of the rolls adapted for passage therebetween of one margin of the web, whereby the margins of the web are brought together on one of said side-by-side rolls and wherein means is provided for sealing the margins to form a longitudinal seam for the tube, the tubular member having notches at its exit end, the entrance end of at least some of the belts being received in the notches.

23. Apparatus for wrapping units to be wrapped comprising:

means for positively and continuously feeding forward a web of sheet material for wrapping the units from a supply roll at a predetermined speed;

the web being provided with lines of weakness extending thereacross at wrapper length intervals;

means for forming the web with the lines of weakness therein into a tube around the units;

a plurality of endless drive belts extending downstream from the tube forming means arranged for passage therebetween of the tube with the units therein;

means for driving said drive belts positively and continuously to take up the web from said web feeding means to pull it through the tube forming means and to feed the tube with the units enwrapped therein forward between the belts at said speed;

means for positively delivering units to be wrapped forward one after another at said speed to the tube forming means for being wrapped in the web travelling forward through the tube forming means, with the units spaced at intervals corresponding to the wrapper length intervals and with spaces between the units;

said tube forming means being so constructed and arranged that the web, in travelling therethrough, is wrapped around the units and its margins brought together to form the web into the tube around the units, with the units spaced lengthwise of the tube, and with the lines of weakness extending girthwise of the tube at said wrapper length intervals in the spaced between the units;

the means for positively delivering the units completing the delivery of each unit to the tube forming means before the wrapping of the web around that unit is completed;

the entrance end of the drive belts being located for engagement of the belts with the tube as the tube, with a unit therein, exits from the tube forming means and before the positive delivery of that unit to the tube is completed;

the segments of the tube between the lines of weakness forming a series of wrappers for the units adapted to be separated at the lines of weakness, and means downstream from said belts for pulling the leading wrapper of the series of wrappers with the units therein forward at a higher speed to sever it, with the unit therein, from the tube at the line of weakness between said leading wrapper and the preceding wrapper.

* * * * *